US007618304B2

(12) United States Patent
Chen

(10) Patent No.: US 7,618,304 B2
(45) Date of Patent: Nov. 17, 2009

(54) BRA PAD

(76) Inventor: Hui-Mei Chen, No. 52, Beinei St., Shulin City, Taipei County 238 (TW)

( * ) Notice: Subject to any disclaimer, the term of this patent is extended or adjusted under 35 U.S.C. 154(b) by 0 days.

(21) Appl. No.: 11/942,017

(22) Filed: Nov. 19, 2007

(65) Prior Publication Data

US 2009/0130952 A1 May 21, 2009

(51) Int. Cl.
*A41C 3/00* (2006.01)

(52) U.S. Cl. ..... 450/38; 450/36; 450/54

(58) Field of Classification Search ..... 450/36, 450/38, 39, 54–58; 2/267, 268; 623/7, 8
See application file for complete search history.

(56) References Cited

U.S. PATENT DOCUMENTS 3,986,213 A * 10/1976 Lynch ..... 623/8
6,857,932 B2 * 2/2005 Chen ..... 450/38
7,144,296 B2 * 12/2006 Chen et al. ..... 450/81

* cited by examiner

*Primary Examiner*—Gloria Hale
(74) *Attorney, Agent, or Firm*—Chun-Ming Shih

(57) ABSTRACT

A bra pad is combined selectively from thermoplastic polyurethane (TPU) films, silicone gel material or silicone gel material layers, lightweight material layers and cloth layers. The TPU films are configured for containing the silicone gel material to make the silicone gel material layer form a concave cup. A space defined in the concave cup is configured for combining the lightweight material layer. The lightweight material layer has an opposite side surface attaching to the cloth layer to form the bra pad. The present bra pad employs the silicone gel material layer to make it have excellent tactility and comfortable, and employs the lightweight material layer to decrease the weight. Furthermore, the cloth layer is configured for increase the breathe capability and the heat-dissipating capability to make the users more comfortable and no burthen when being carried for a long time or in sports.

6 Claims, 10 Drawing Sheets

BRA PAD

FIELD OF THE INVENTION

The present invention relates to bra pads, and more specifically, to a bra pad made of a combination combined selectively from materials selected from a group consisting of thermoplastic polyurethane (TPU) films, silicone gel layers, lightweight material layers and cloth layers, and having functions with light weight, excellent tactility and velvet, good breathe capability and heat-dissipating capability.

DESCRIPTION OF THE RELATED ART

A conventional bra pad is manufactured by filling liquid-state silicone gel into a chamber formed by a TPU film, and further by solidifying the liquid-state silicone gel. The conventional bra pad may be used for users by cooperating with a bra. The conventional bra pad is a finished product, however, the conventional bra pad has some disadvantages described as following:

1. The conventional bra pad is entirely made of silicone gel, thus it is very weighty, and tends to increase load of the users.

2. Since the conventional bra pad is very weighty, when the users carry the conventional bra pad for a long time or in sport, sweat or heat generated from the users cannot be dissipated effectively, thus the breathe capability and the heat-dissipating capability thereof is bad. Therefore, the conventional bra pad is not favored by the users.

To solve the above problems, another conventional bra pad is manufactured by adding vesicant into the liquid-state silicone gel to decrease the weight of the conventional bra pad. However, since the specific gravity of the vesicant is less than 1, the vesicant tends to float in the silicone gel and congregate together. Thus the vesicant is distributed nonuniformly. The conventional bra pad has a bad tactility and handle, and the conventional bra pad is nonuniform, therefore, it affects greatly the comfort thereof.

The inventors of the present invention invent a bra pad through working experience and larger investigation for solving the above problems.

What is needed is a bra pad which can solve the above problems.

BRIEF SUMMARY

An object of the present invention is providing a bra pad, which can decrease the whole weight thereof, to remain a dry and comfortable state when the users carry the bra pad of the present invention for a long time or in sports.

Another object of the present invention is providing a bra pad, which can enhance the soft comfortable capability, and have an excellent handle. Furthermore, the bra pad of the present invention can make the whole cup elasticity, specific gravity, and active feeling thereof fit with the skin of people, to make the users more comfortable.

The bra pad in accordance with a preferred embodiment of the present invention, is made from combining selectively from materials selected from a group consisting of TPU films, silicone gel material or silicone gel material layers, lightweight material layers and cloth layers. The TPU films are configured for containing the silicone gel material to make the silicone gel material layer form a concave cup. A space defined in the concave cup is configured for combining the lightweight material layer. The lightweight material layer has another opposite side surface attaching to the cloth layer to form the bra pad. The present bra pad employs the silicone gel material layer to make it have excellent tactility and comfortable, and employs the lightweight material layer to decrease the weight thereof. Furthermore, the cloth layer is configured for increase the breathe capability and the heat-dissipating capability to make the users more comfortable and no burthen when being carried for a long time or in sports.

Other objects, advantages and novel features of the invention will become more apparent from the following detailed description when taken in conjunction with the accompanying drawings, in which:

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Reference will now be made to the drawings to describe a preferred embodiment of the present bra pad, in detail.

Figure 1A:
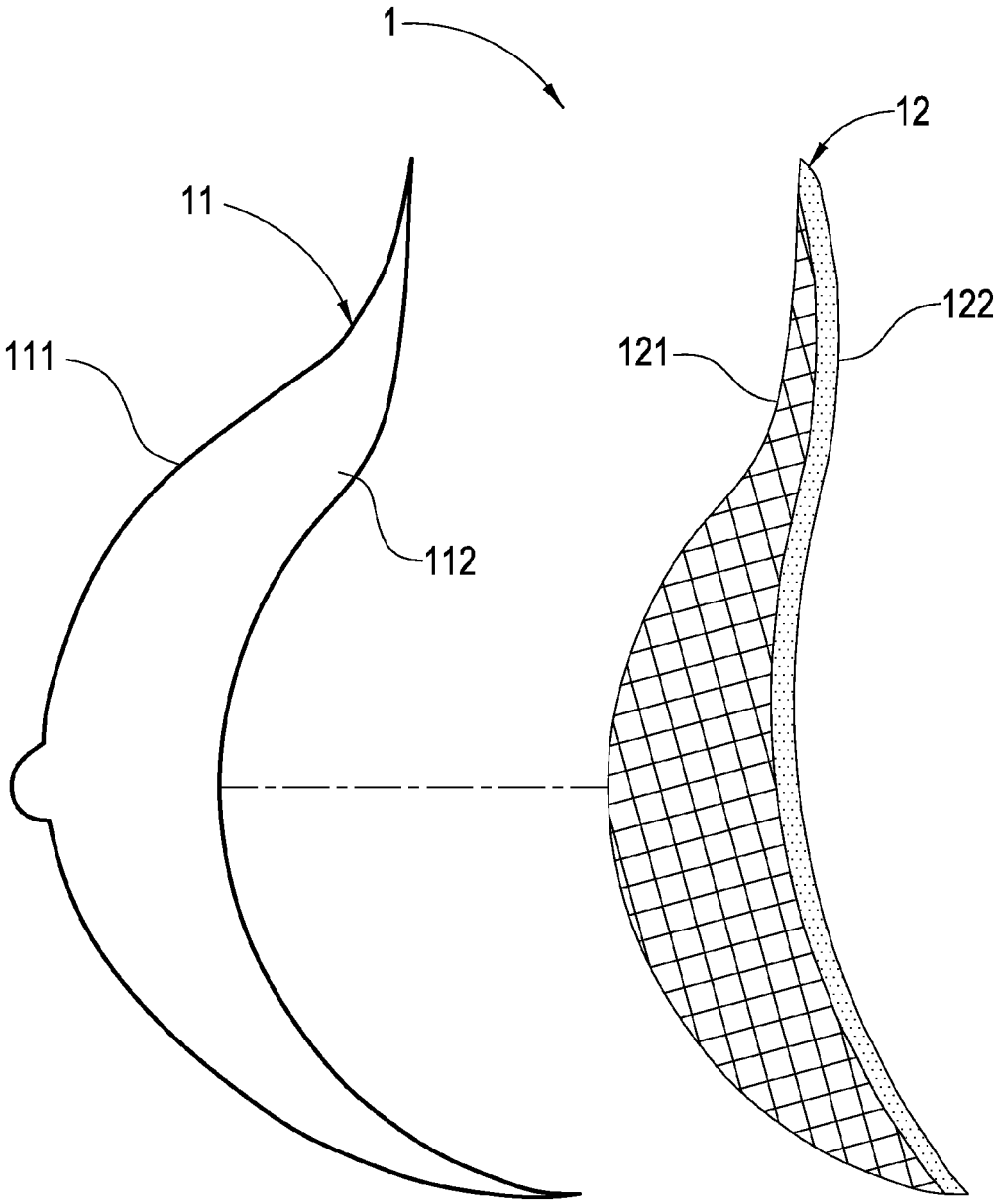
FIG. 1A is a schematic, exploded view of a bra pad of a first preferred embodiment of the present invention.
Figure 1B:
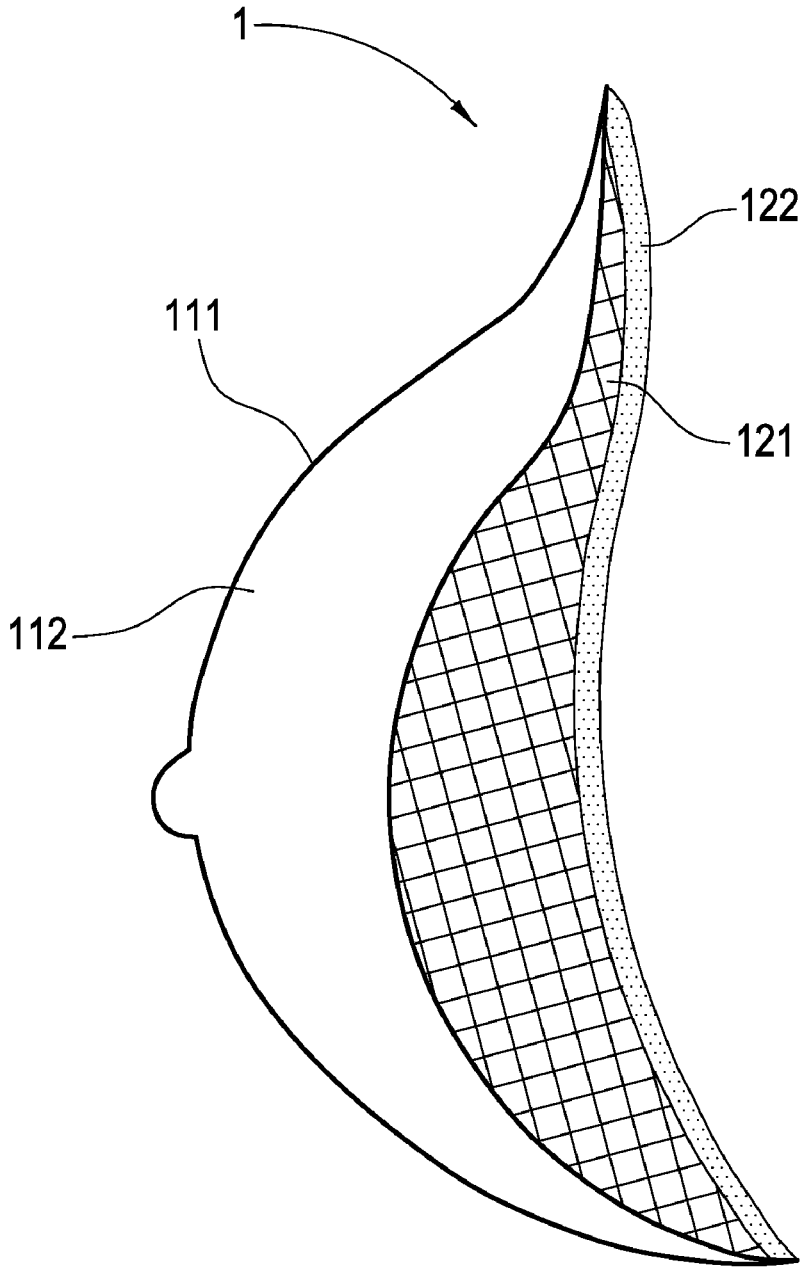
FIG. 1B is a schematic, cross-sectional view of the bra pad of FIG. 1A.

Referring to FIGS. 1A and 1B, a bra pad 1 in accordance with a first preferred embodiment of the present invention is shown. The bra pad 1 includes: a silicone gel layer 11 and a lightweight layer 12 having a cloth layer.

The silicone gel layer 11 is manufactured by containing silicone gel material 112 in a polyurethane (TPU) film 111. The silicone gel material 112 may be liquid-state silicone gel, liquid-state silicone rubber, or a silicone gel material filling hollow microspheres therein. The silicone gel layer 11 is manufactured to be a concave cup. The hollow microspheres may be hollow glass microspheres or thermoplastic microspheres.

The lightweight layer 12 having a cloth layer includes a lightweight material layer 121 and a cloth layer 122. The lightweight material layer 121 may be PU vesicant, expanded polystyrene, heat expandable microspheres of floss. The lightweight material layer 121 has a side surface attaching on the cloth layer 122 and another opposite side surface being configured for attaching of the silicone gel layer 11. Furthermore, a TPU film may be arranged between the lightweight material layer 121 and the cloth layer 122.

Combining the silicone gel layer 11 aned the lightweight layer 12 having the cloth layer can form the bra pad 1.

Figure 2A:
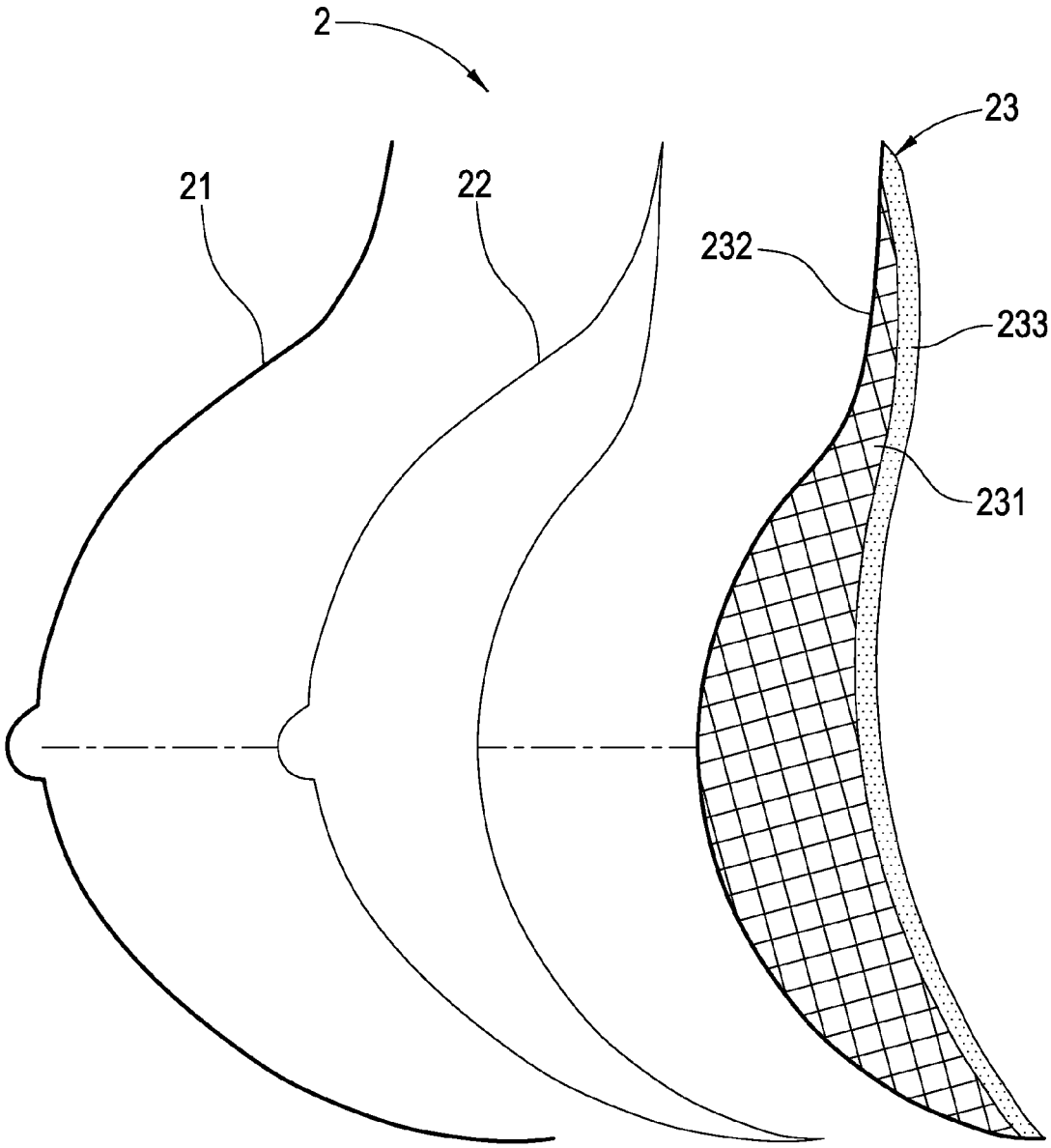
FIG. 2A is a schematic, exploded view of a bra pad of a second preferred embodiment of the present invention.
Figure 2B:
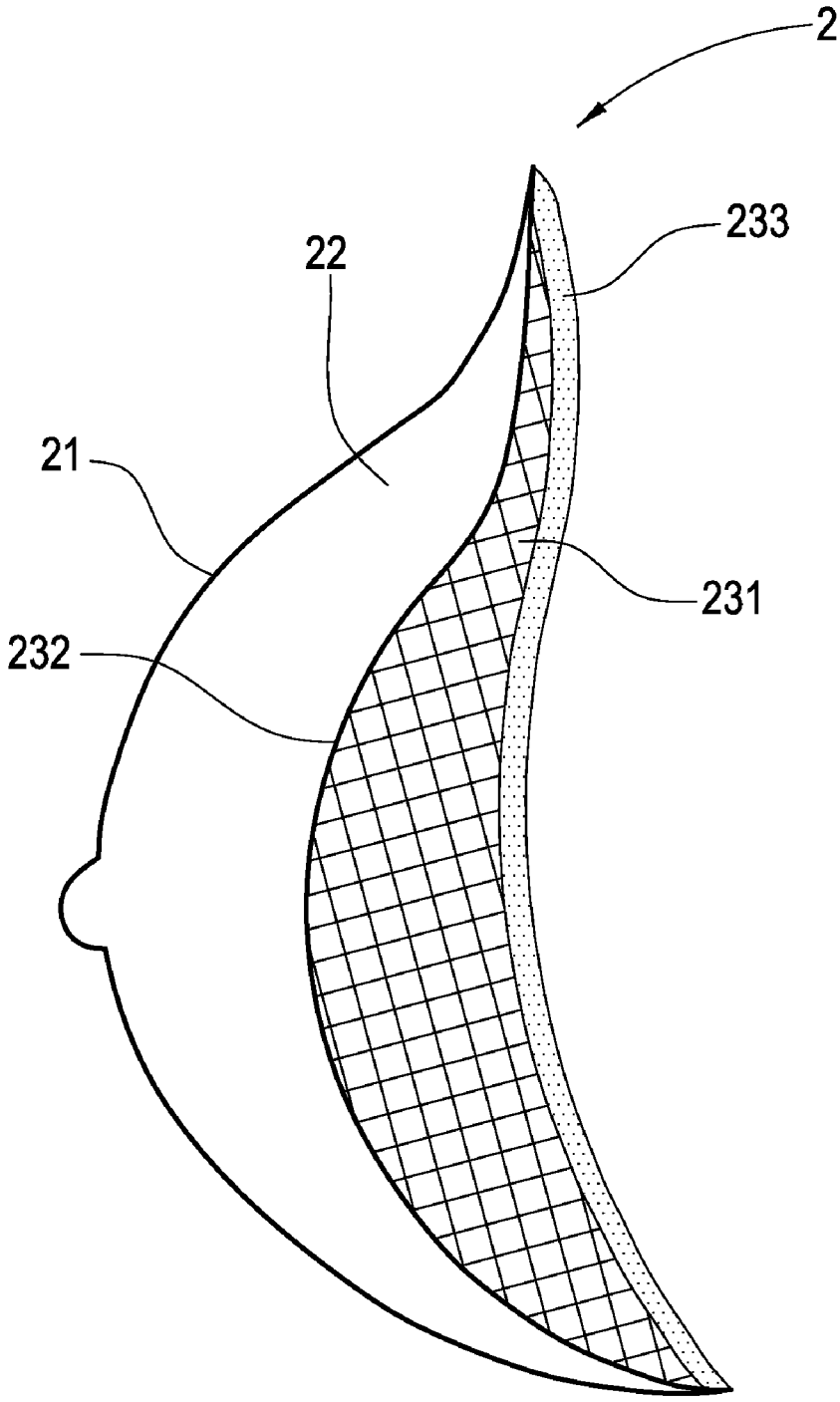
FIG. 2B is a schematic, crossed-sectional view of the bra pad of FIG. 2A.

Referring to FIGS. 2A and 2B, a bra pad 2 in accordance with a second preferred embodiment of the present invention is shown. The bra pad 2 includes: a TPU film 21, a silicone gel material 22 and a lightweight layer 23 having a TPU film and a cloth layer.

The silicone gel material 22 may be liquid-state silicone gel, liquid-state silicone rubber, or a silicone gel material filling hollow microspheres therein. The hollow microspheres filled in the silicone gel material, may be hollow glass microspheres or thermoplastic microspheres.

The lightweight layer 23 having the TPU film and the cloth layer includes a lightweight material layer 231, a TPU film 232 and a cloth layer 233. The lightweight material layer 231 may be PU vesicant, expanded polystyrene, heat expandable microspheres of floss. The lightweight material layer 231 has a side surface attaching on the TPU film 232, and another opposite side surface attaching on the cloth layer 233. Furthermore, a TPU film may be arranged between the lightweight material layer 231 and the cloth layer 233.

The TPU film 21, the silicone gel material 22, and the lightweight layer 23 having the TPU film and the cloth layer, are combined by a mode selected from a group of high frequency, supersonic, and heat-melting, such that the silicone gel material 22 is sealed between the two TPU films 21, 232 to form the bra pad 2

Figure 3A:
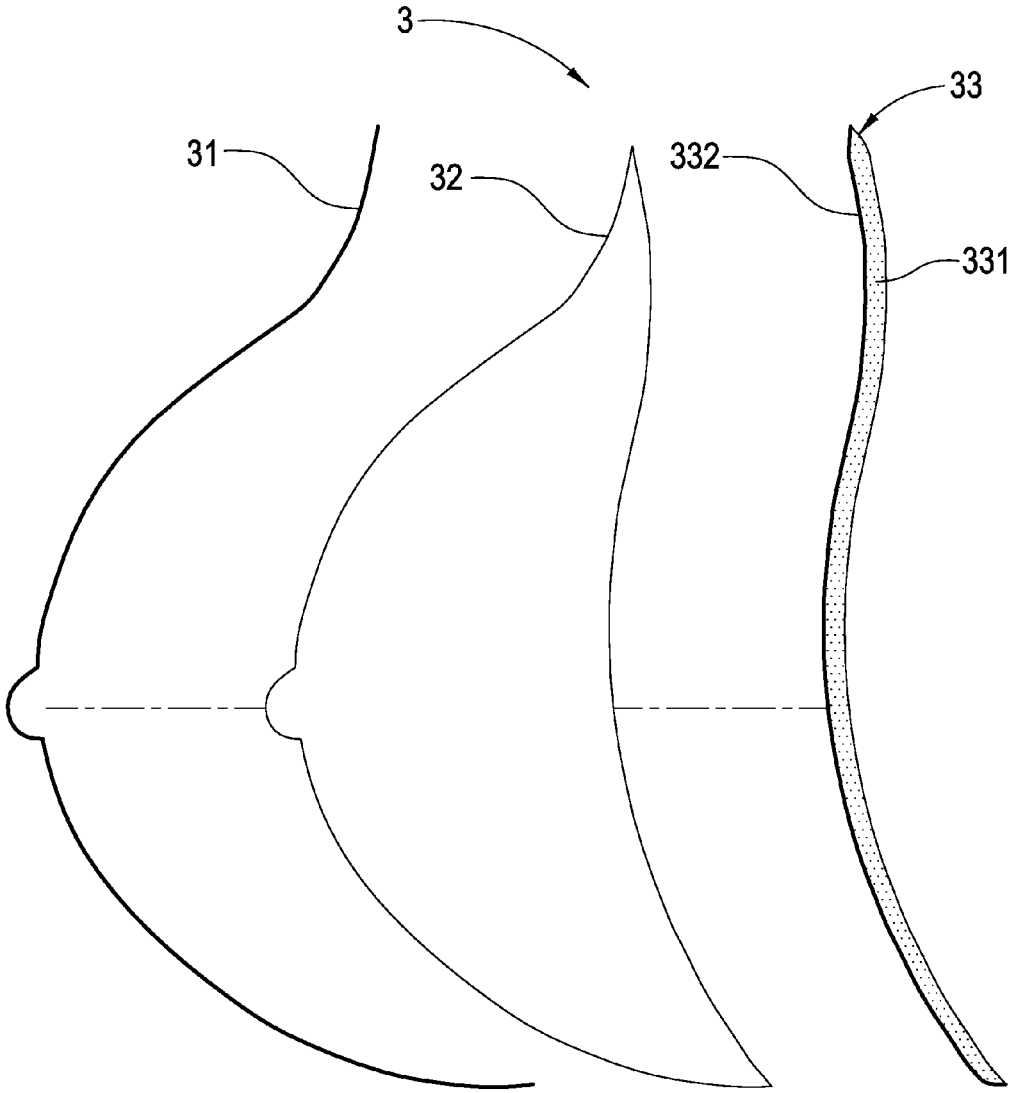
FIG. 3A is a schematic, exploded view of a bra pad of a third preferred embodiment of the present invention.
Figure 3B:
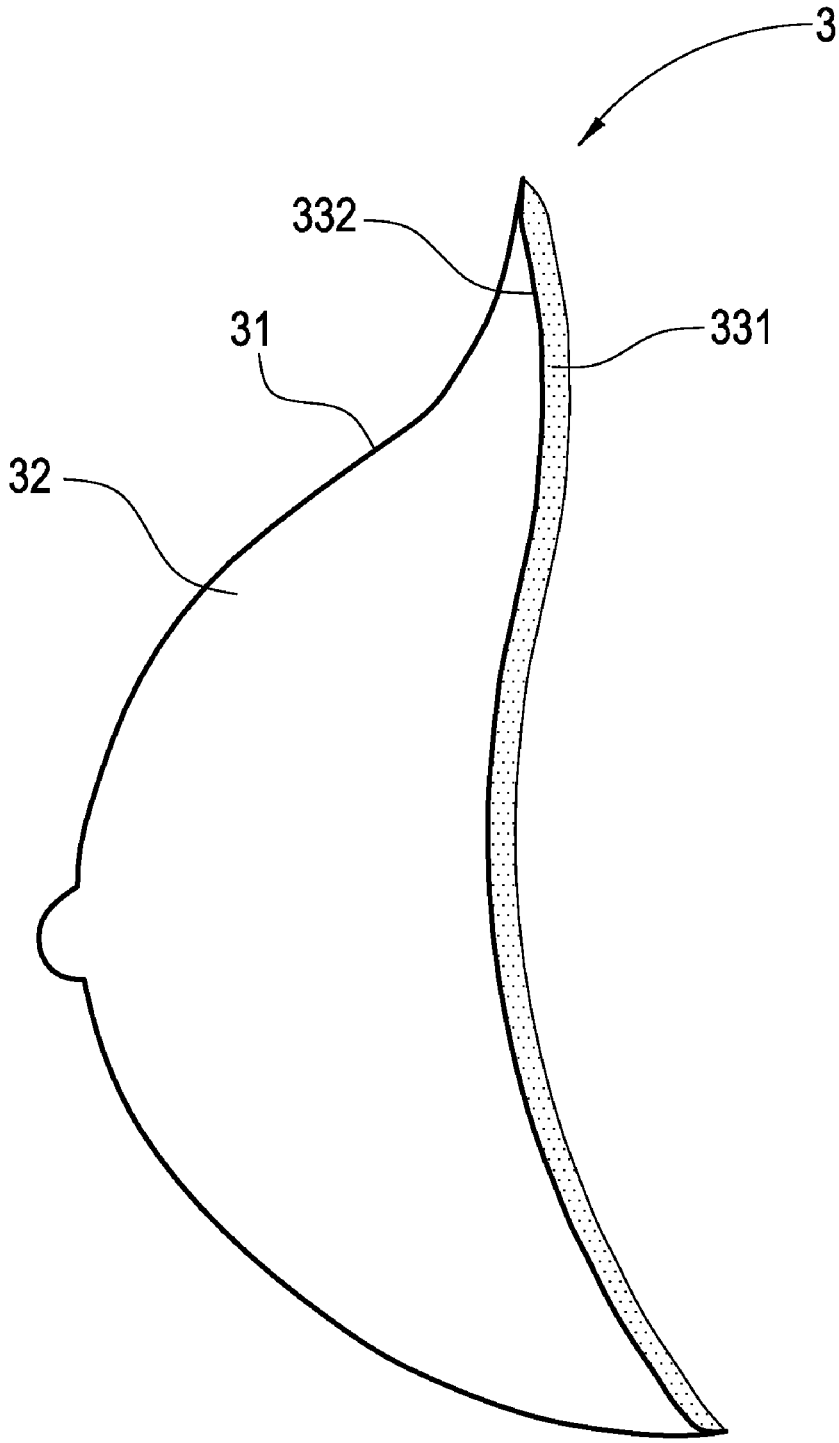
FIG. 3B is a schematic, crossed-sectional view of the bra pad of FIG. 3A.

Referring to FIGS. 3A and 3B, a bra pad 3 in accordance with a third preferred embodiment of the present invention is shown. The bra pad 3 includes: a TPU film 31, a silicone gel material 32 and a cloth layer 33 having a TPU film.

The silicone gel material 32 may be liquid-state silicone gel, liquid-state silicone rubber, or a silicone gel material filling hollow microspheres therein. The hollow microspheres filled in the silicone gel material, may be hollow glass microspheres or thermoplastic microspheres.

The cloth layer 33 having the TPU film has a cloth layer 331 and a TPU film 332.

The TPU film 31, the silicone gel material 32, and the cloth layer 33 having the TPU film, are combined by a mode selected from a group of high frequency, supersonic, and heat-melting, such that the silicone gel material 32 is sealed between the two TPU films 31, 332 to form the bra pad 3.

Figure 4A:
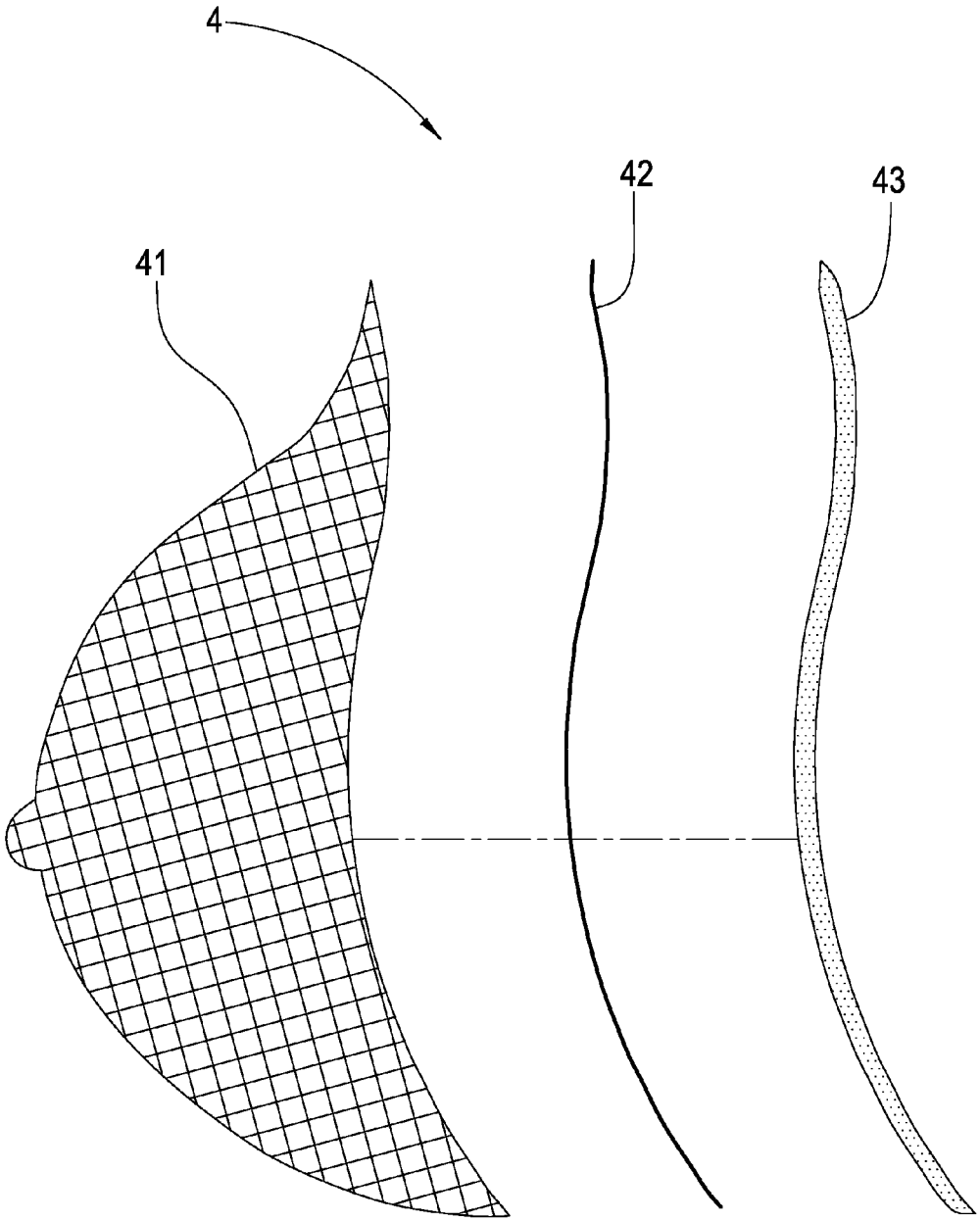
FIG. 4A is a schematic, exploded view of a bra pad of a fourth preferred embodiment of the present invention.
Figure 4B:
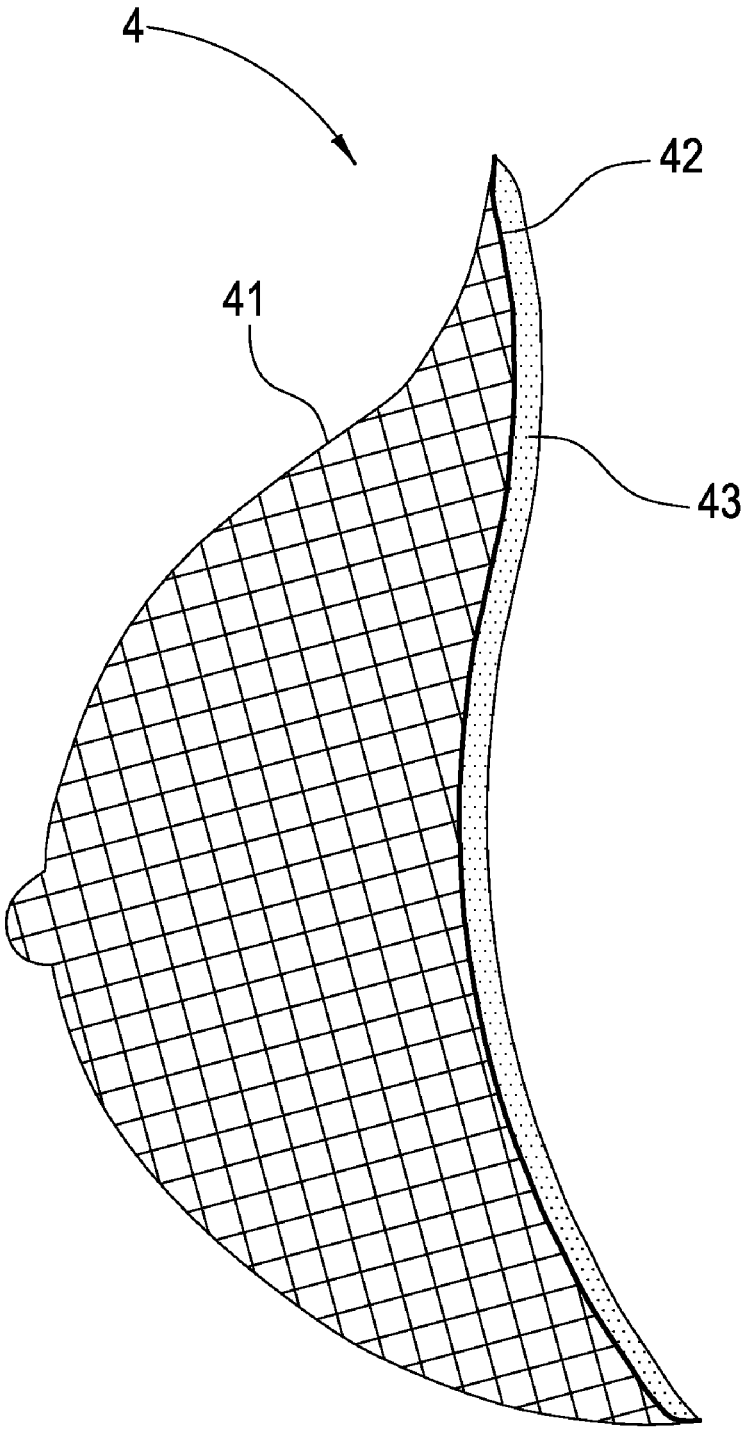
FIG. 4B is a schematic, crossed-sectional view of the bra pad of FIG. 4A.

Referring to FIGS. 4A and 4B, a bra pad 4 in accordance with a fourth preferred embodiment of the present invention is shown. The bra pad 4 includes: a lightweight material layer 41, a TPU film 42, and a cloth layer 43.

The lightweight material layer 41 may be PU vesicant, expanded polstyrene, heat expandable microspheres or floss.

The TPU film 42 is arranged between the lightweight material layer 41 and the cloth layer 43.

The cloth layer 43 is attached on a side surface of the TPU film 42.

The lightweight material layer 41, the TPU film 42, and the cloth layer 43 are combined together by a mode selected from a group of high frequency, supersonic, heat-melting and gluing, to form the bra pad 4.

Figure 5A:
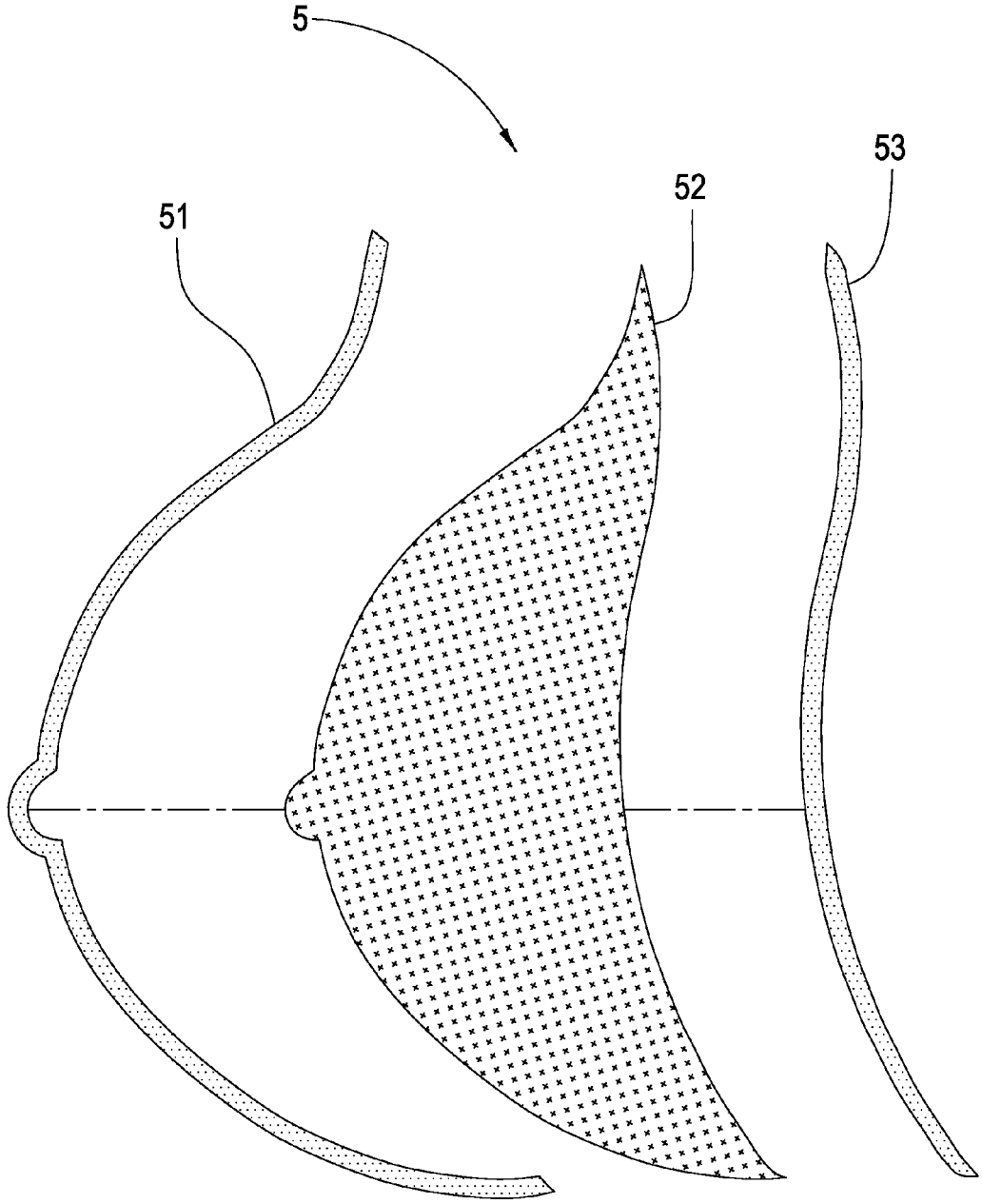
FIG. 5A is a schematic, exploded view of a bra pad of a fifth preferred embodiment of the present invention.
Figure 5B:
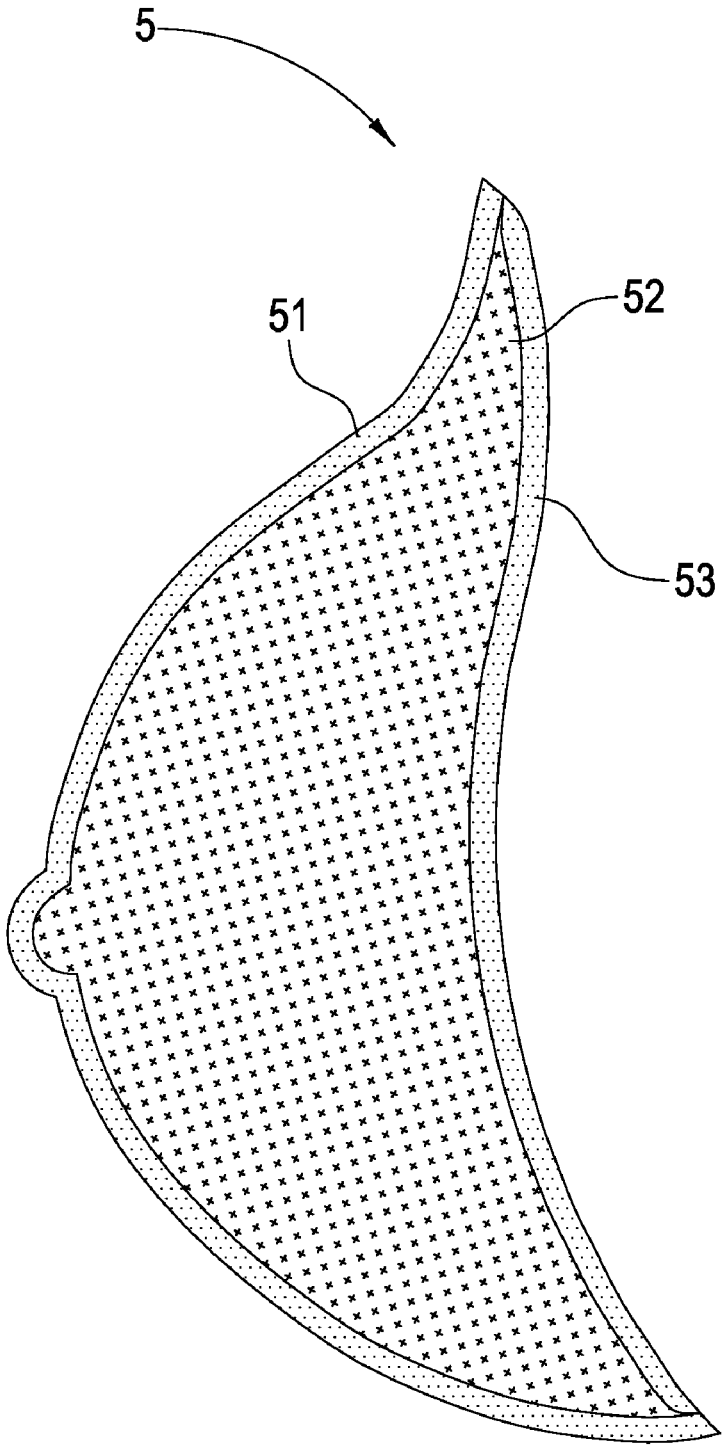
FIG. 5B is a schematic, crossed-sectional view of the bra pad of FIG. 5A.

Referring to FIGS. 5A and 5B, a bra pad 5 in accordance with a fifth preferred embodiment of the present invention is shown. The bra pad 5 includes: a front cloth layer 51, a lightweight material layer 52, and a back cloth layer 53.

The lightweight material layer 52 is arranged between the front cloth layer 51 and the back cloth layer 53. The lightweight material layer 52 may be PU vesicant, expanded polstyrene, heat expandable microspheres or floss.

The front cloth layer 51, the lightweight material layer 52, and the back cloth layer 53 are combined by a mode selected from a group of high frequency, supersonic, and heat-melting, such that the lightweight material layer 52 is contained between the front cloth layer 51 and the back cloth layer 53 to form the bra pad 5.

Since the bra pads described as the above embodiments, have a light weight, the bra pads can lay silicone gel having adhesive capability, on the cloth layers contacting with skin, to make the bra pads have self-adhesive capability.

Comparing with the conventional arts, the bra pads of the present invention have the following advantages:

1. The bra pads of the present invention can decrease the whole weight thereof, to remain a dry and comfortable state when the users carry the bra pads of the present invention for a long time or in sports.
2. The bra pads of the present invention, can enhance the soft comfortable capability, and have an excellent handle. Furthermore, the bra pads of the present invention can make the whole cup elasticity. Specific gravity, and active feeling thereof fit with the skin of people, to make the users more comfortable.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A bra pad comprising:

a first thermoplastic polyurethane (TPU) film;

a silicone gel material, a second TPU film, a cloth layer; and a lightweight material layer selected from a group consisting of polyurethane (PU) vesicant, expanded polystyrene, heat expandable microspheres and floss, arranged between the second TPU film and the cloth layer, the lightweight material layer having a side surface and an opposite side surface, the side surface attaching on the second TPU film, the opposite side surface attaching on the cloth layer, wherein the first TPU film, the silicone gel material, and the second TPU film attached on the lightweight material layer are combined together to form the bra pad.

2. The bra pad as claimed in claim 1, wherein the silicone gel, material is selected from any one of a group consisting of liquid-state silicone gel, liquid-state silicone rubber, or a silicone gel material filling hollow microspheres therein.

3. The bra pad as claimed in claim 2, wherein the hollow microspheres of the silicone gel material are hollow glass microspheres or thermoplastic microspheres.

4. The bra pad as claimed in claim 1, wherein the first TPU film, the silicone gel material and the second TPU film attached on the lightweight material layer are combined by a mode selected from a group of high frequency, supersonic, and heat-melting, such that the silicone gel material is sealed between the first and the second TPU films.

5. The bra pad as claimed in claim 1, further comprising a third TPU film arranged between the lightweight material layer and the cloth layer.

6. The bra pad as claimed in claim 1, wherein the cloth layer has a surface contacting with skin of a user, and the surface has adhesive silicone gel thereon to make the bra pad have self-adhesive capability.

* * * * *